US010718149B2

(12) United States Patent
Liu

(10) Patent No.: US 10,718,149 B2
(45) Date of Patent: Jul. 21, 2020

(54) SECTIONAL DOOR DRIVING DEVICE

(71) Applicant: GLADOOR TAIWAN LIMITED, Taoyuan (TW)

(72) Inventor: Ya-Chen Liu, Taoyuan (TW)

(73) Assignee: GLADOOR TAIWAN LIMITED, Taoyuan (TW)

( * ) Notice: Subject to any disclaimer, the term of this patent is extended or adjusted under 35 U.S.C. 154(b) by 195 days.

(21) Appl. No.: 15/964,125

(22) Filed: Apr. 27, 2018

(65) Prior Publication Data

US 2019/0330906 A1 Oct. 31, 2019

(51) Int. Cl.

| | |
|---|---|
| ***E05F 15/60*** | (2015.01) |
| ***B66D 1/60*** | (2006.01) |
| ***B66D 1/14*** | (2006.01) |

(52) U.S. Cl.

CPC ..... *E05F 15/60* (2015.01); *B66D 1/14* (2013.01); *B66D 1/60* (2013.01); *E05Y 2900/106* (2013.01)

(58) Field of Classification Search

CPC ..... E05F 15/60; E05F 15/668; E05F 15/686; E05Y 2900/106; E05Y 2201/434; E05Y 2201/22; E05Y 2201/238; E05Y 2201/71; E05Y 2201/716; E05Y 2201/726; B66D 1/14; B66D 1/60

See application file for complete search history.

(56) References Cited

U.S. PATENT DOCUMENTS

| | | | | |
|---|---|---|---|---|
| 4,472,910 | A * | 9/1984 | Iha | E05F 15/686 160/189 |
| 5,698,073 | A * | 12/1997 | Vincenzi | E05B 65/0021 160/188 |
| 6,134,835 | A * | 10/2000 | Krupke | E05D 13/1261 160/191 |
| 6,401,792 | B1 * | 6/2002 | Mullet | F16D 41/04 160/188 |
| 6,401,793 | B1 * | 6/2002 | Martin | E05D 13/1261 160/189 |
| 6,568,454 | B1 * | 5/2003 | Mullet | E05F 15/41 160/188 |
| 7,367,160 | B2 * | 5/2008 | Mullet | E05D 13/1261 160/188 |
| 7,607,263 | B2 * | 10/2009 | Mullet | E05D 13/1261 160/188 |
| 9,234,377 | B2 * | 1/2016 | Schatz | E05F 15/668 |
| 9,605,476 | B2 * | 3/2017 | Hall | E06B 9/38 |

(Continued)

*Primary Examiner* — Michael E Gallion

(74) *Attorney, Agent, or Firm* — Bacon & Thomas, PLLC

(57) ABSTRACT

The present disclosure illustrates a sectional door driving device including a power assembly, a chassis assembly and a driving assembly. The power assembly includes a motor, a gear set and a control unit, and the power assembly is fastened on a main chassis of the chassis assembly. The driving assembly includes two half-gears respectively in semicircular cylinder shape, and each of the two half-gears has a combination surface which is formed with an engagement assembly, and the two half-gears are engaged by the engagement assemblies thereof to form a circular gear to cover a shaft of a sectional door mechanism. The gear set includes an output gear configured to drive the circular gear and the shaft to rotate. The sectional door driving device can be separated from the shaft easily for repair, and the sectional door driving device can also be installed on the existing sectional door easily.

10 Claims, 10 Drawing Sheets

(56) References Cited

U.S. PATENT DOCUMENTS

| | | | | |
|---|---|---|---|---|
| 10,000,960 | B2 * | 6/2018 | Angiuli | E05F 15/686 |
| 2005/0235563 | A1 * | 10/2005 | Mullet | E05D 13/1261 49/200 |
| 2006/0090861 | A1 * | 5/2006 | Wu | E05F 15/686 160/188 |
| 2006/0191205 | A1 * | 8/2006 | Mullet | E05F 15/668 49/199 |
| 2006/0237150 | A1 * | 10/2006 | Olmsted | E05F 15/668 160/200 |
| 2007/0051477 | A1 * | 3/2007 | Fraser | E06B 9/262 160/84.05 |

* cited by examiner

SECTIONAL DOOR DRIVING DEVICE

BACKGROUND OF THE INVENTION

1. Field of the Invention

The present disclosure relates to a driving device for door, more particularly to a sectional door driving device.

2. Description of the Related Art

A sectional door is usually equipped with a building gate, a garage or a wider channel, and also usually called an iron rolling door, quickly-rolling door or a garage lift door. Please refer to FIG. 11. FIG.11 which shows a perspective view of a conventional sectional door device. A sectional door 9 includes a door leaf 91 formed by multiple door pieces, which can be jointed with each other to bend. The two sides of the door leaf 91 are slidably accommodated in sliding tracks 92. When the door leaf 91 is closed, the door leaf 91 is located at vertical sliding tracks 921 below; and, when the door leaf 91 is opened, the door leaf 91 is received in the horizontal sliding track 922 above. An electronic mechanism 93 drives the door leaf 91 to move, and includes power structures such as motor and gear set. The electronic mechanism 93 is located at an end of a middle track 94 which is fastened on the ceiling by several middle track supports 941. The electronic mechanism 93 is usually linked to a drag rod 942 of other end of the middle track 94 by a rope or a screw rod (not shown in FIG. 11). The drag rod 942 is linked to the uppermost part of the door leaf 91, and when the electronic mechanism 93 acts, the door leaf 91 can be pulled upwardly or put down.

In order to decrease the load of the electronic mechanism 93, a shaft 95 is disposed at an upper part of the door leaf 91 and springs 96 are mounted at two ends of the shaft 95. The spring 96 has an end combined with the shaft 95 and other end locked with a board fixed with the building. When the door leaf 91 is put down, the spring 96 has been rolled by several times to store a restoring force close to a weight of the door leaf 91, so that the motor having smaller horsepower is still able to lift the door leaf 91. The electronic mechanism 93 drives rotation of the shaft 95 through a bevel gear (not shown in FIG. 11) located at an end portion of a transmission rod. This transmission structure is well known in the art, so description of the transmission structure is not repeated. A rope wheel 97 is disposed at the two ends of the shaft 95, and configured to transmit the rotation force of the shaft 95 to the bottom of the door leaf 91 through a rope or cable, thereby assisting in lifting the door leaf 91.

In aforementioned conventional structure, the middle track 94 and the electronic mechanism 93 at the end of the middle track 94 occupy the upper space of the sectional door; and, when the middle track 94 is located at the high position, it needs precise construction and easily causes high construction difficulty; however, if the middle track 94 and the electronic mechanism 93 are located at the middle section of the building, they are collided and damaged more easily.

For this reason, what is needed to develop a sectional door driving device to solve abovementioned problem.

SUMMARY OF THE INVENTION

In order to solve the problem that it is not easy to repair, disassemble and replace the conventional sectional door, the present disclosure is to provide a sectional door driving device.

According to an embodiment, the present disclosure provides a sectional door driving device including a power assembly, a chassis assembly and a driving assembly, and the power assembly includes a motor, a gear set and a control unit, and the power assembly is fastened on a main chassis of the chassis assembly. The driving assembly includes two half-gears respectively in semicircular cylinder shape, and each of the two half-gears has a combination surface which is formed with an engagement assembly, and the two half-gears are engaged with each other by the engagement assemblies thereof to form a circular gear to cover a shaft of a sectional door mechanism, and the gear set comprises an output gear configured to drive the circular gear and the shaft to rotate.

Preferably, the main chassis is formed with a gap to pass the shaft.

Preferably, the sectional door driving device includes two half-bearings configured to engage with each other to mount on the shaft.

Preferably, each of the two half-gears is formed with at least one counterbore configured to lock with a screw.

Preferably, the engagement assembly of each of the two half-gears includes an engagement structure including a protruded part and a recessed part in cooperation with each other.

Preferably, the circular gear is covered by two half rope wheels, and the two half rope wheels are assembled with each other as a rope wheel by engagement assemblies thereof, and the rope wheel is wound by a rope.

Preferably, the engagement assembly of each of the two half-rope wheels includes an engagement structure comprising a protruded part and a recessed part in cooperation with each other.

Preferably, the chassis assembly includes an auxiliary chassis which is formed with several holes and at least one combination board configured to combine with the main chassis by a fastener.

Preferably, the rope includes a first combination end configured to combine with a bottom part of a door leaf.

Preferably, the rope includes a second combination end configured to combine with a top part of the door leaf.

According above-mentioned content, the driving device of the present disclosure can be separated from the shaft easily for repair, or it is easy to install the driving device of the present disclosure on the existing sectional door to replace the existing driving device; furthermore, the installation of the driving device of the present disclosure does not need the middle track, so that the installation of the driving device of the present disclosure is easier than the convention driving device.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1:
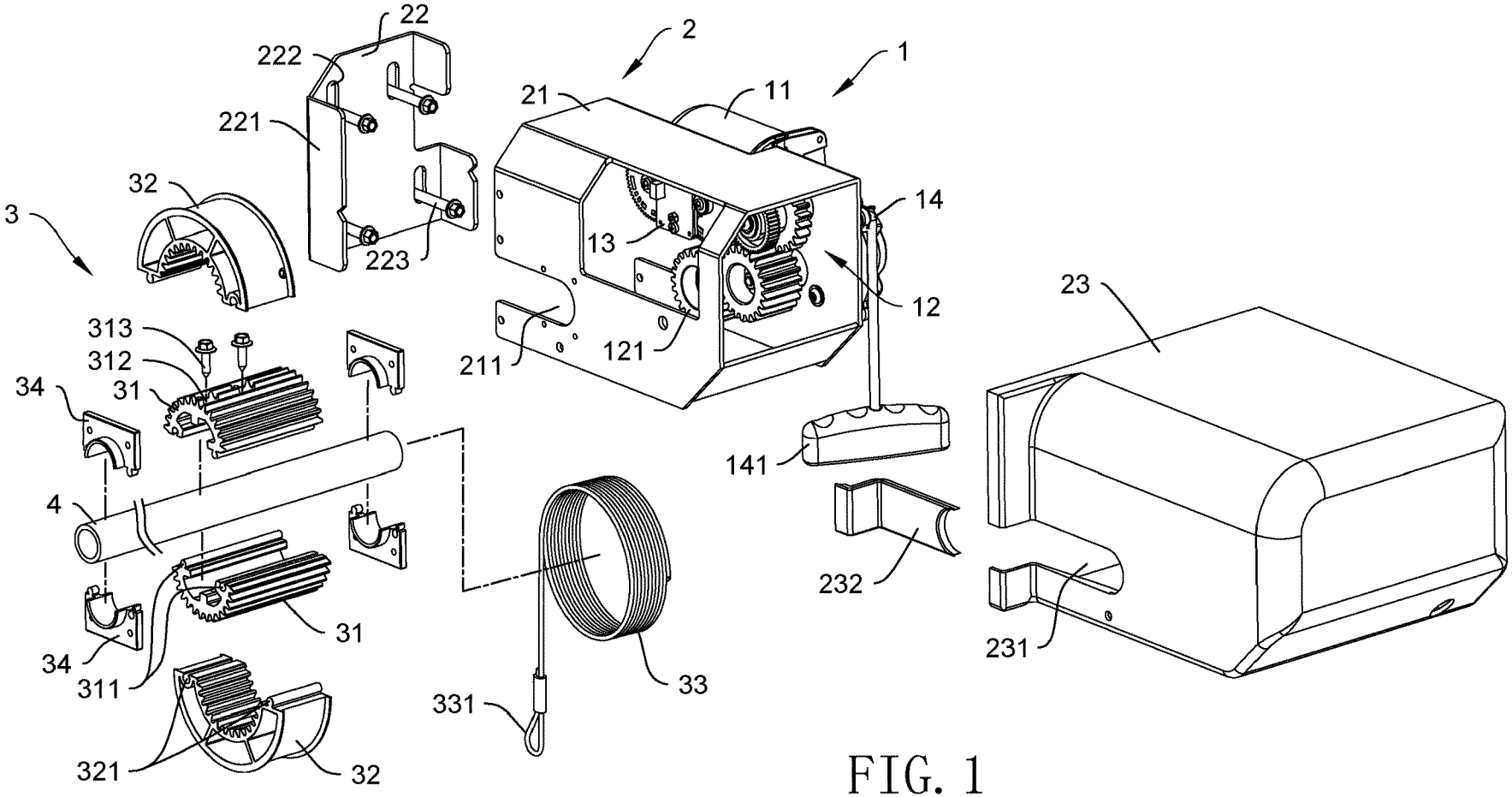
FIG. 1 is an exploded view of a first embodiment of a sectional door driving device of the present disclosure.

The following embodiments of the present disclosure are herein described in detail with reference to the accompanying drawings. These drawings show specific examples of the embodiments of the present disclosure. It is to be understood that these embodiments are exemplary implementations and are not to be construed as limiting the scope of the present disclosure in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

Figure 2:
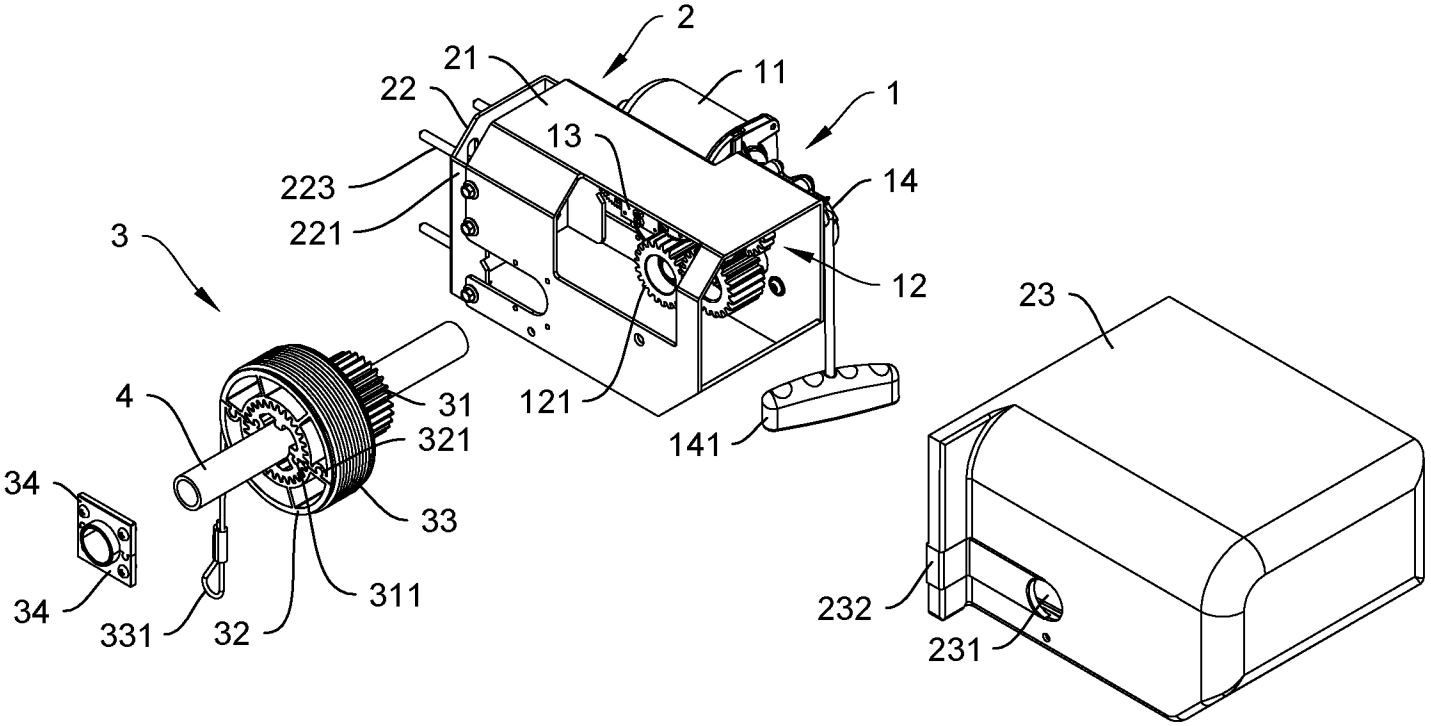
FIG. 2 is a perspective view of an assembled part and a disassembled part of the first embodiment of the sectional door driving device of the present disclosure.
Figure 3:
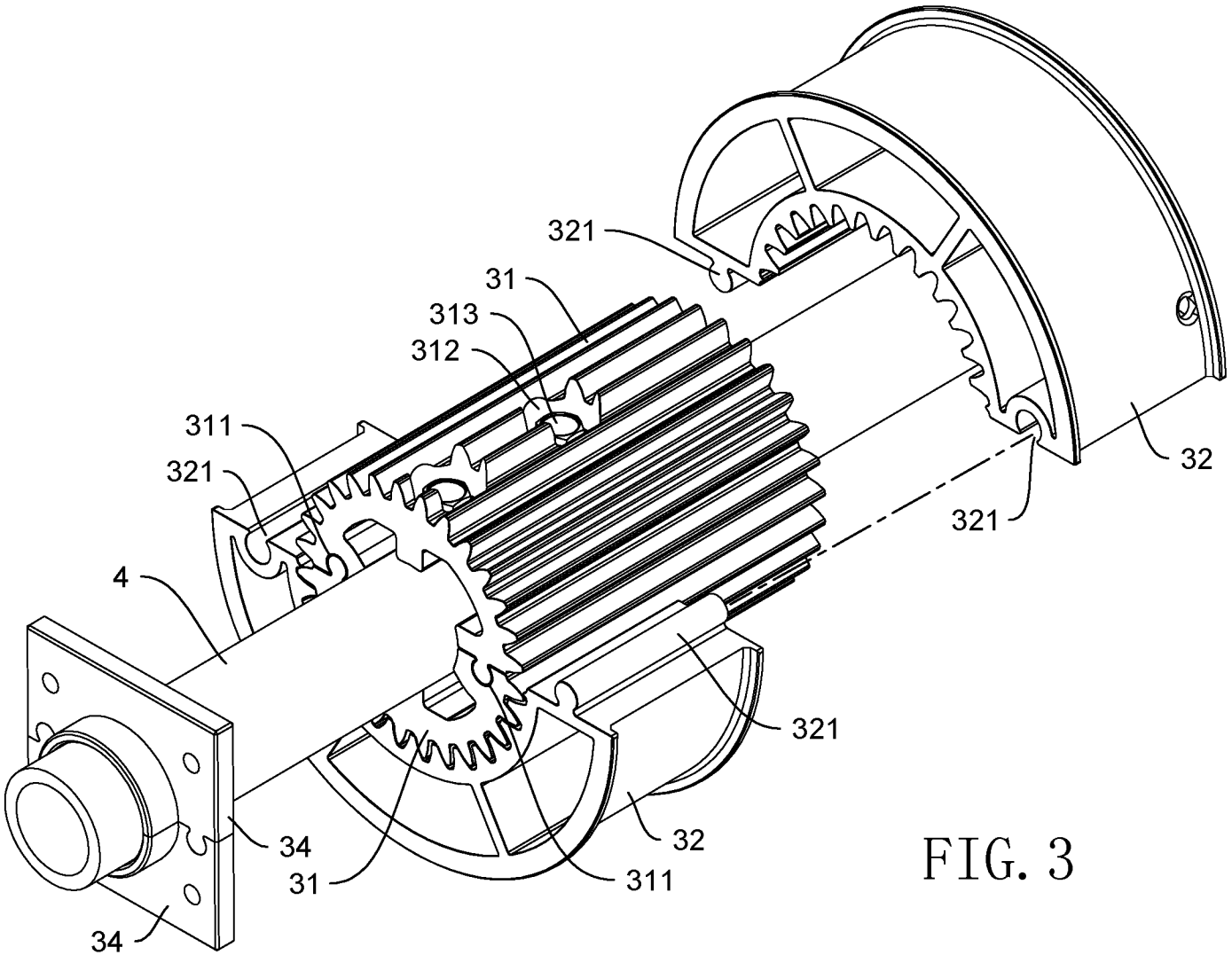
FIG. 3 is a perspective view of disassembly and assembly of a part of the first embodiment of the sectional door driving device of the present disclosure.

Please refer to FIGS. 1 through 3. FIG. 1 is an exploded view of a first embodiment of a sectional door driving device of the present disclosure, FIG. 2 is a perspective view of an assembled part and a disassembled part of the first embodiment of the sectional door driving device of the present disclosure, and FIG. 3 is a perspective view of assembly and disassembly of a part of the first embodiment of the sectional door driving device of the present disclosure. In this embodiment, the sectional door driving device of the present disclosure includes a power assembly 1, a chassis assembly 2 and a driving assembly 3.

The power assembly 1 includes a motor 11, a gear set 12, a control unit 13 and a switcher 14. The power assembly 1 is fastened with a main chassis 21 of the chassis assembly 2. The motor 11 is operated to perform variable-speed transmission through the gear set 12, and the gear set 12 transmits power to an output gear 121. The control unit 13 is configured to count during action of the power assembly 1 or read a location of the power assembly 1, so as to determine a location of the sectional door and then generate a correct instruction according to the determination. The function of the switcher 14 is similar to a clutch, and the switcher 14 includes a switch handle 141 configured to switch link between the motor 11 and the output gear 121, and in a condition that power failure or motor fault occurs, the user can manually open or close the sectional door. The control unit 13 and the switcher 14 of this embodiment are well known technology in the art, so their descriptions are not repeated.

The chassis assembly 2 includes the main chassis 21 and an auxiliary chassis 22. Preferably, the chassis assembly 2 may include an outer chassis 23 to have better appearance and prevent dust and vapor from entering the chassis assembly 2. The main chassis 21 is formed as a shell with a proper size to accommodate the components. The main chassis 21 is formed with a gap 211 cut therethrough to pass a shaft 4 of the sectional door. The auxiliary chassis 22 is formed with several holes 222 cut through a board thereof, and several screws 223 can be inserted through the holes 222 respectively to fasten the driving device with a building. The auxiliary chassis 22 includes at least one combination board 221 extended from two sides thereof. The outer chassis 23 can cover the main chassis 21 and the auxiliary chassis 22, and is formed with a gap 231 to pass the shaft 4 of the sectional door. After the sectional door driving device is mounted completely, a cover board 232 can be used to cover the sectional door driving device, thereby improving the sealability of entire device.

The driving assembly 3 includes two half-gears 31 in semicircular cylinder shape. Each of the two half-gears 31 includes an engagement assembly 311 formed on a combination surface thereof. By engaging the engagement assemblies 311 with each other, the two half-gears 31 can be assembled as a circular gear to cover the shaft 4 of the sectional door mechanism. Each half-gear 31 has the same shape, and the engagement assembly 311 is an engagement structure having a protruded part and a recessed part. In this embodiment, the engagement assembly 311 can include a circular rib and a circular groove which can be tightly mounted with each other. In order to assemble the driving device, one of the two half-gears 31 is placed on a surface of the shaft 4, and the circular rib and circular groove of the engagement assembly 311 of the other half-gear 31 correspond in position to and are slid into the circular groove and the circular rib of the half-gear 31 for combination. Each of the two half-gears 31 has at least one counterbore 312 formed on the outer surface thereof, the screw 313 can be locked into the counterbore 312. Preferably, the screw 313 can be, but not limited to, a tapping screw which can be locked into the surface of the shaft 4. The circular gear formed by the two half-gears 31 can be disposed on the outer surface of the shaft 4, so as to tightly combine the circular gear with the shaft 4.

After the two half-gears 31 and the shaft 4 are combined and fixed, the auxiliary chassis 22 is locked at a proper location on a wall of the building, and the main chassis 21 is attached on the auxiliary chassis 22 to engage the output gear 121 with the circular gear formed by the two half-gears 31, and some fasteners such as the tapping screws, are used to lock the main chassis 21 with the combination board 221 of the auxiliary chassis 22; finally, the outer chassis 23 covers the assembly, so as to complete assembly of the sectional door driving device. After assembly, the driving device is able to drive the shaft 4 to rotate; that is, the motor 11 can transmit power to the output gear 121 through the gear set 12, and the output gear 121 engages the circular gear formed by the two half-gears 31, so as to drive the shaft 4 to rotate.

Preferably, there are two half-bearings 34 disposed in the gap 211 of the main chassis 21, and each of the two half-bearings 34 can have a structure, which is similar to the engagement assembly 311 of the half-gear 31, to combine with the shaft 4, and the two half-bearings 34 are then fastened in the gap 211 by screw. Preferably, the half-bearing 34 can be, but not limited to, a slidable bearing made by plastic material or copper. The bearing can improve stability of combination between the driving device and the shaft 4.

In this embodiment, the two half-gears 31 are detachably assembled to form the circular gear which is then combined with the shaft 4, and the half-bearings 34 are combined with the shaft 4 by the similar manner, so that the half-gears 31 and the half-bearings 34 can be assembled to directly cover the outer surface of the shaft 4. When the driving device must be disassembled to separate from the shaft 4 because of device failure or any reason, the half-gears 31 can be disassembled from the shaft 4 by just loosening the screw 313. On the other hand, when the sectional door driving device of the present disclosure is to install on an existing sectional door mechanism, for example, the existing sectional door mechanism does not work and is to be replaced by the driving device of the present disclosure, the installation of the driving device of the present disclosure can be completed without disassembling the existing mechanism.

The two half-gears 31 of the present disclosure can be assembled as a complete circular gear, and one of ordinary skill in the art can understand the two half-gears 31 can be replaced by three one-third-circular gears equivalently.

Above-mentioned embodiment is applicable to the sectional door having the rope wheel; furthermore, the sectional door driving device of the present disclosure can include a rope wheel to pull the sectional door by rope. Please refer FIGS. 1-3. The circular gear formed by two half-gears 31 is covered by half rope wheels 32, and each half rope wheel 32 includes wheel teeth formed on an inner ring surface thereof and matching with the half-gear 31, and the each half rope wheel 32 also includes an engagement assembly 321. The engagement assemblies 321 of the half rope wheels 32 can be assembled as a rope wheel on which a rope 33 is wound. Preferably, the engagement assembly 321 can be an engagement structure including a protruded part and a recessed part. In this embodiment, the engagement assembly 321 can include a circular rib and a circular groove which can be tightly mounted with each other. In order to assemble the driving device, the circular rib and circular groove of the engagement assembly 321 of one of the half rope wheels 32 is slid into the circular groove and the circular rib of the engagement assembly 321 of the other of the half rope wheels 32 for assembly, and the assembled half rope wheels 32 are mounted on the outer surface of the circular gear formed by the two half-gears 31. The rope 33 can be made by flexible but non-extensible material, for example, the rope 33 can be, but not limited to, a steel cable, a nylon rope, a petrochemical textile rope, a fiber braided rope or a cotton rope.

Figure 4:
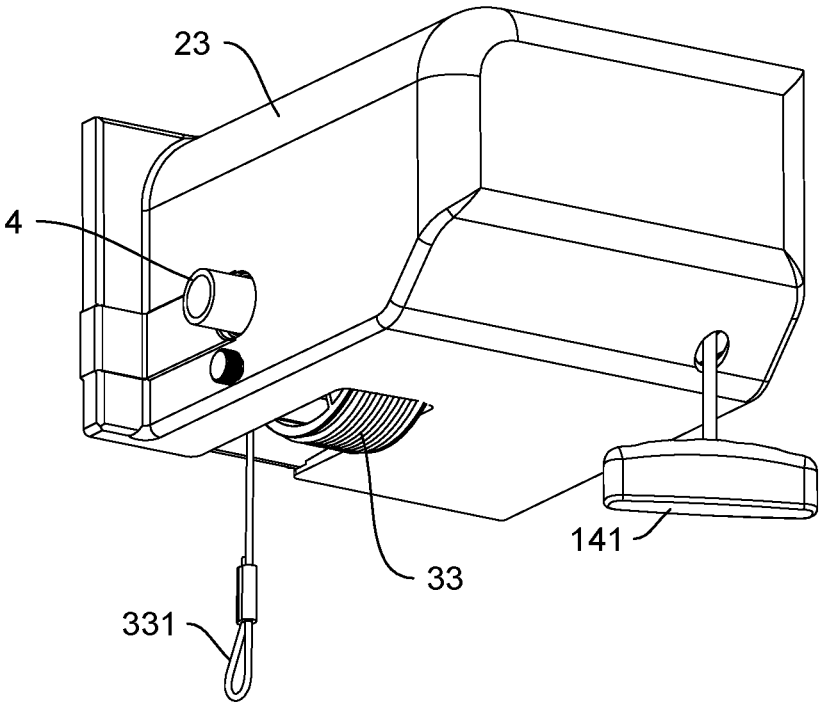
FIG. 4 is a perspective view of the first embodiment of the sectional door driving device of the present disclosure.
Figure 5:
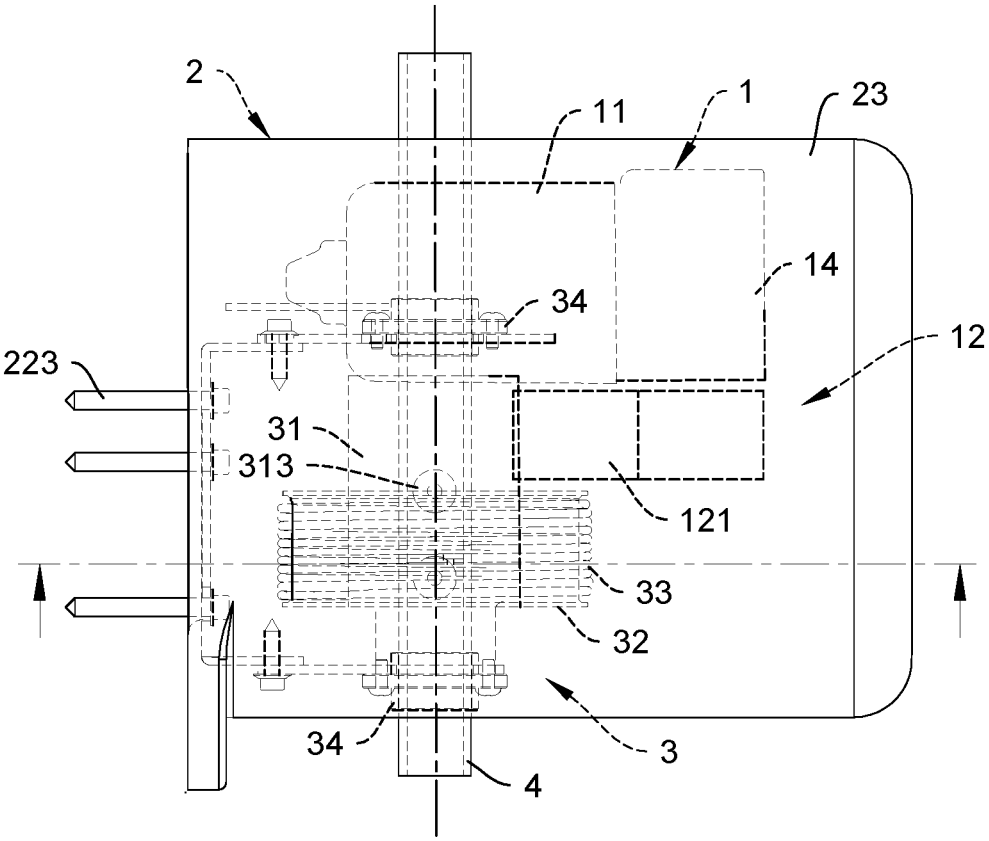
FIG. 5 is a top view of the first embodiment of the sectional door driving device of the present disclosure.
Figure 6:
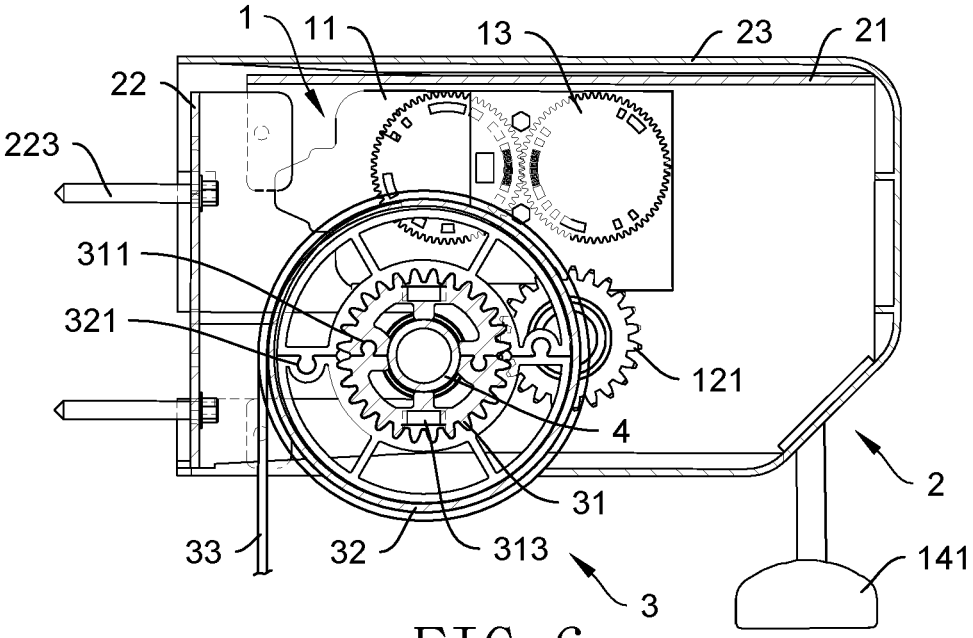
FIG. 6 is a sectional view taken along line A-A of FIG. 5.
Figure 7:
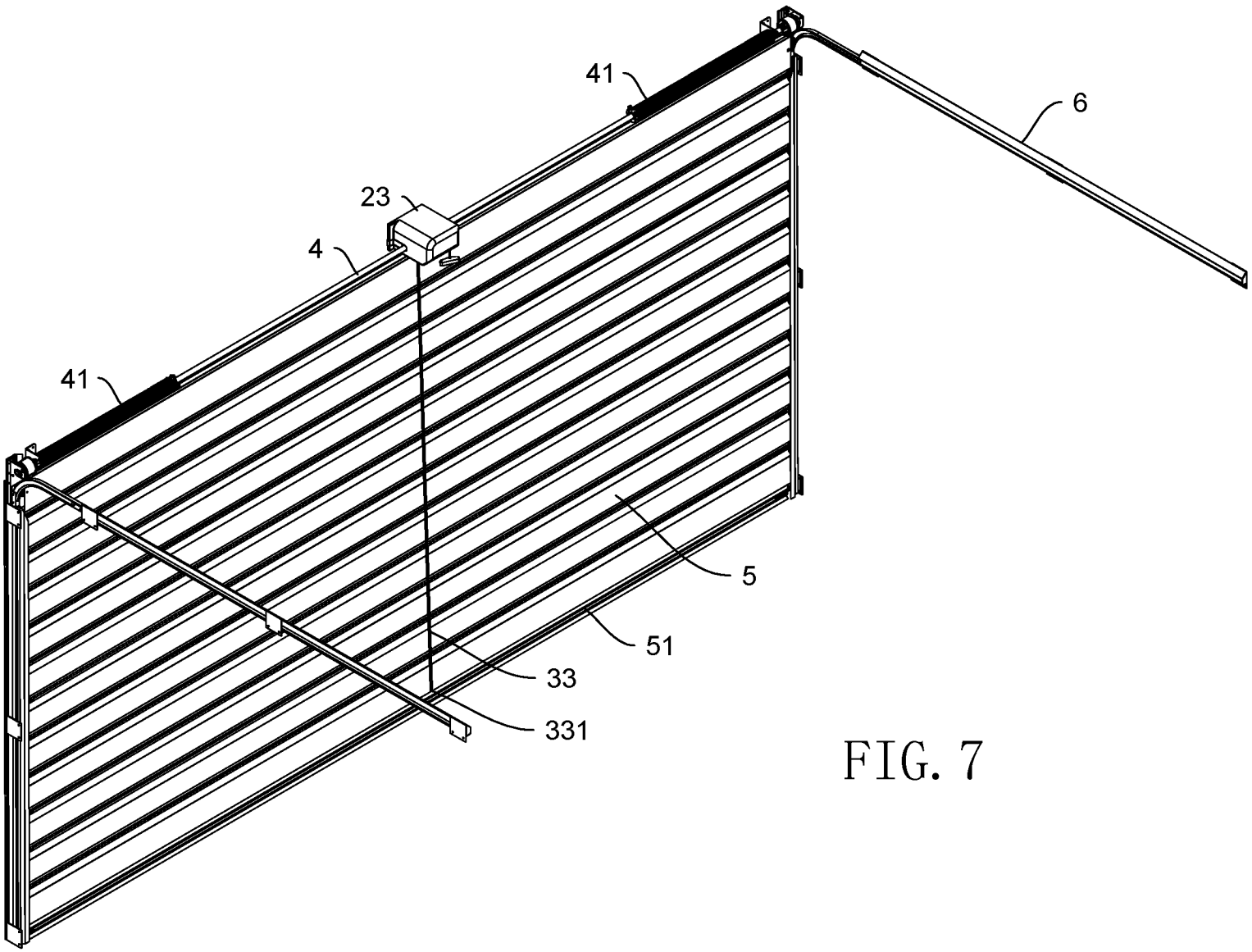
FIG. 7 is a perspective view of the first embodiment of the sectional door driving device equipped with a sectional door, in accordance with the present disclosure.

Please refer to FIGS. 4-7. FIG. 4 is a perspective assembled view of a first embodiment of a sectional door driving device of the present disclosure, FIG. 5 is a top view of assembly of the first embodiment of the sectional door driving device of the present disclosure, FIG. 6 is a sectional view taken along line A-A of FIG. 5, and FIG. 7 is a perspective view of the first embodiment of a sectional door driving device equipped with a sectional door, in accordance with the present disclosure. For ease of explanation, unnecessary components are omitted in FIG. 5 and FIG. 6. The rope 33 is wound on the outer surface of the rope wheel formed by the half rope wheels 32, an end of the rope 33 is fastened with one of the half rope wheels 32, and other end of the rope 33 is served as a first combination end 331. Please refer to FIG. 7. The sectional door driving device of this embodiment is assembled with the shaft 4, and the first combination end 331 of the rope 33 is fastened with the bottom door leaf 51 of the door leaf 5. When the door leaf 5 is put down, springs 41 disposed at two sides of the shaft 4 store a restoring force. After the driving device acts, the door leaf 5 is lifted upwardly by the first combination end 331 of the rope 33, thereby receiving the door leaf 5 into the upper space along a sliding rail 6, to open a channel After the door leaf 5 is put down, the bottom door leaf 51 pulls the rope 33 downwardly, so that the driving device rotates the shaft 4 to wind the spring 41 with assistance of weight of the door leaf 5, thereby storing the restoring force.

Figure 8:
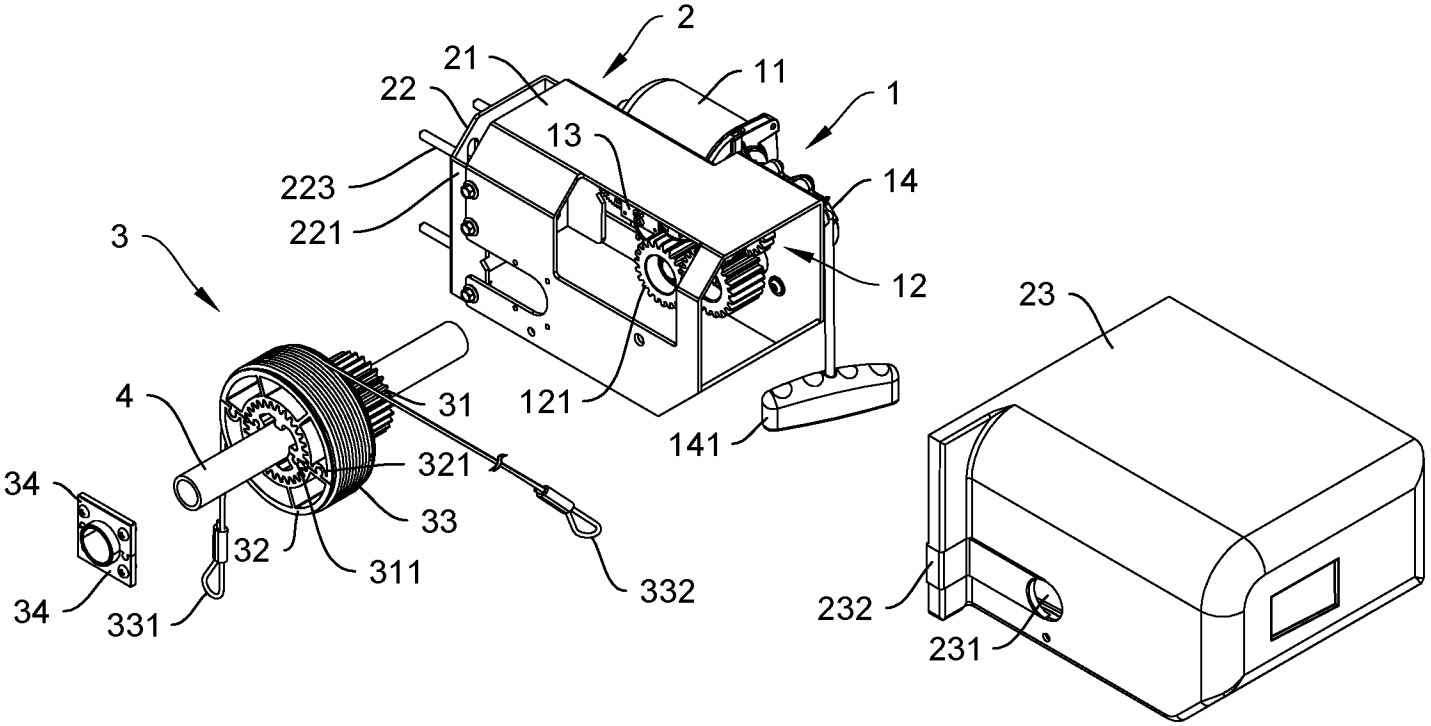
FIG. 8 is a perspective view of an assembled part and a disassembled part of a second embodiment of a sectional door driving device of the present disclosure.
Figure 9:
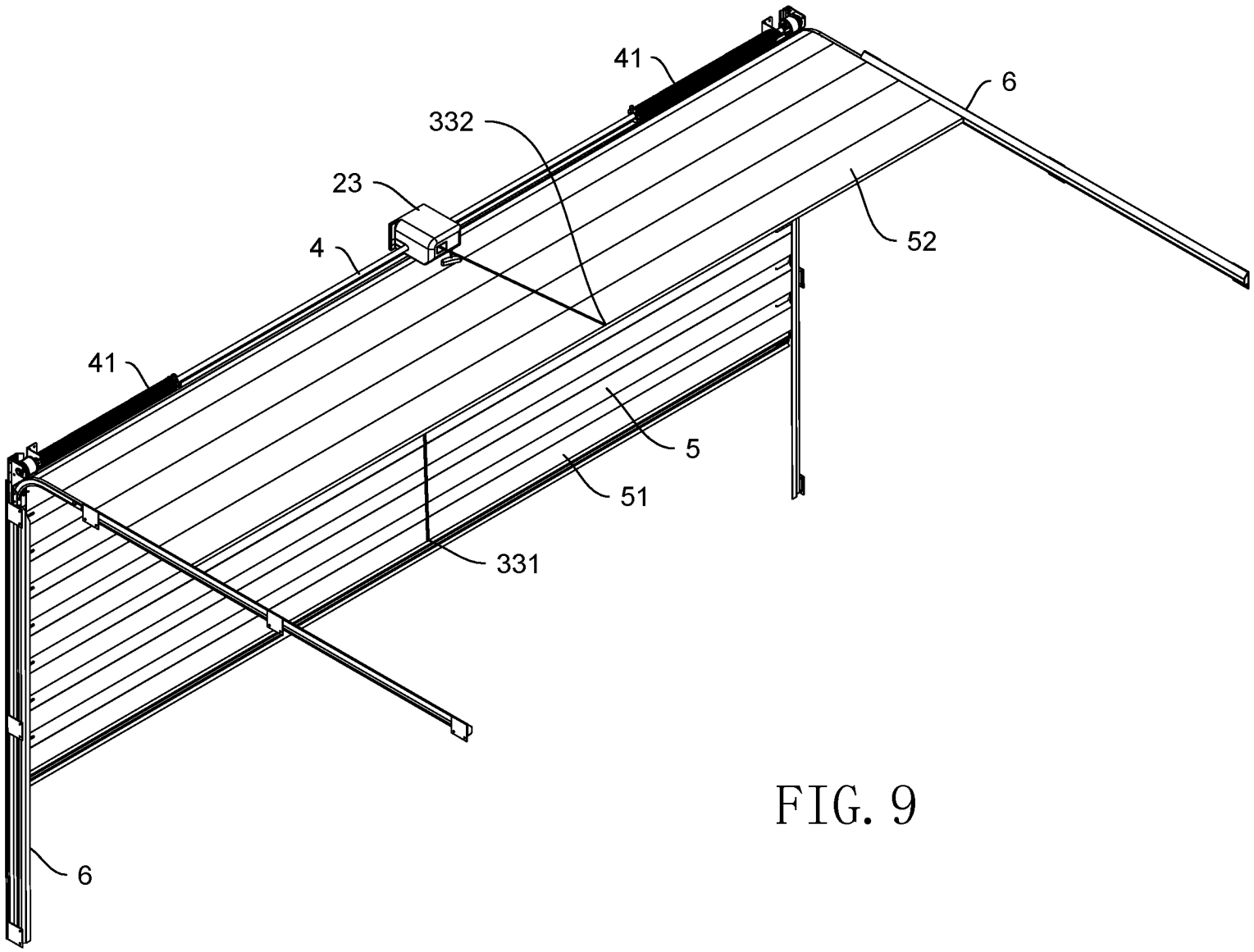
FIG. 9 is a perspective view of the second embodiment of the sectional door driving device equipped with the sectional door, in accordance with the present disclosure.

Please refer to FIGS. 8 and 9. FIG. 8 is a perspective view of an assembled part and a disassembled part of a second embodiment of a sectional door driving device of the present disclosure, and FIG. 9 is a perspective view of the second embodiment of the sectional door driving device equipped with the sectional door, in accordance with the present disclosure. The difference between the second embodiment and the first embodiment is that the rope 33 of the second embodiment includes a second combination end 332. The first combination end 331 of the rope 33 is combined with the bottom door leaf 51 of the door leaf 5, and the second combination end 332 is passed through a hole (not shown in figures) of the outer chassis 23 and combined and fixed with the top door leaf 52 of the door leaf 5. After the driving device acts to open the sectional door, the first combination end 331 of the rope 33 pulls the door leaf to move upwardly, and other end of the rope 33 is released because the top door leaf 52 pulls the second combination end 332, so that the door leaf 5 is received into the upper space along the sliding rail 6, to open the channel When the door leaf 5 is put down, the bottom door leaf 51 pulls the first combination end 331 to release the end of the rope 33 downwardly, and the second combination ends 332 of rope 33 pulls the top door leaf 52 to move door leaf 5 downwardly. The two ends of the rope 33 are respectively fastened with the bottom door leaf 51 and top door leaf 52 of the door leaf 5, so that the door leaf 5 is reliably moved correspondingly to rotation of the driving device; when the door leaf 5 is put down in a door closed state, the top door leaf 52 of the door leaf 5 is pulled by the second combination end 332, so that the door leaf 5 is unable to open until the driving device is activated.

Figure 10:
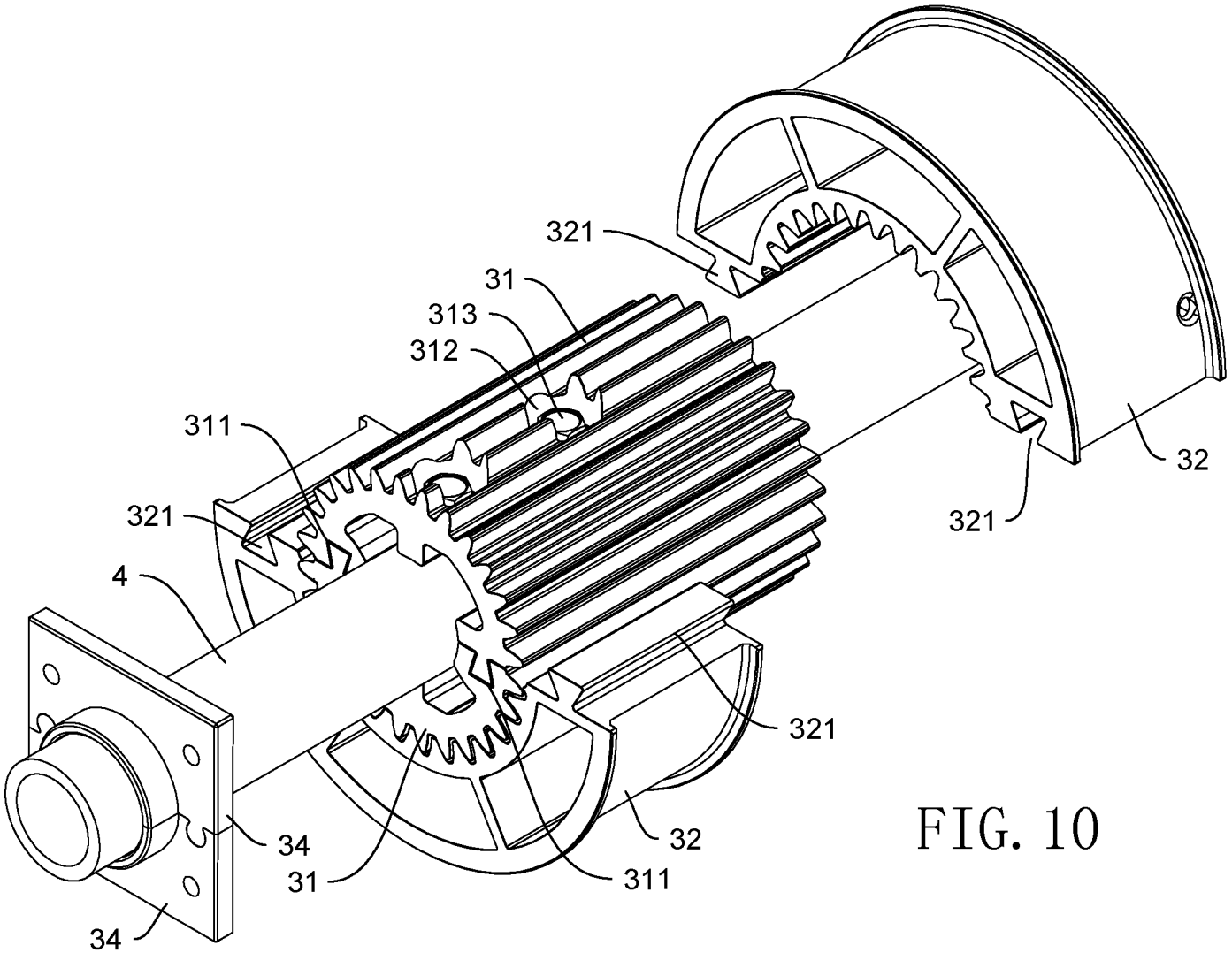
FIG. 10 is a perspective view of assembly and disassembly of a part of a third embodiment of a sectional door driving device of the present disclosure.
Figure 11:
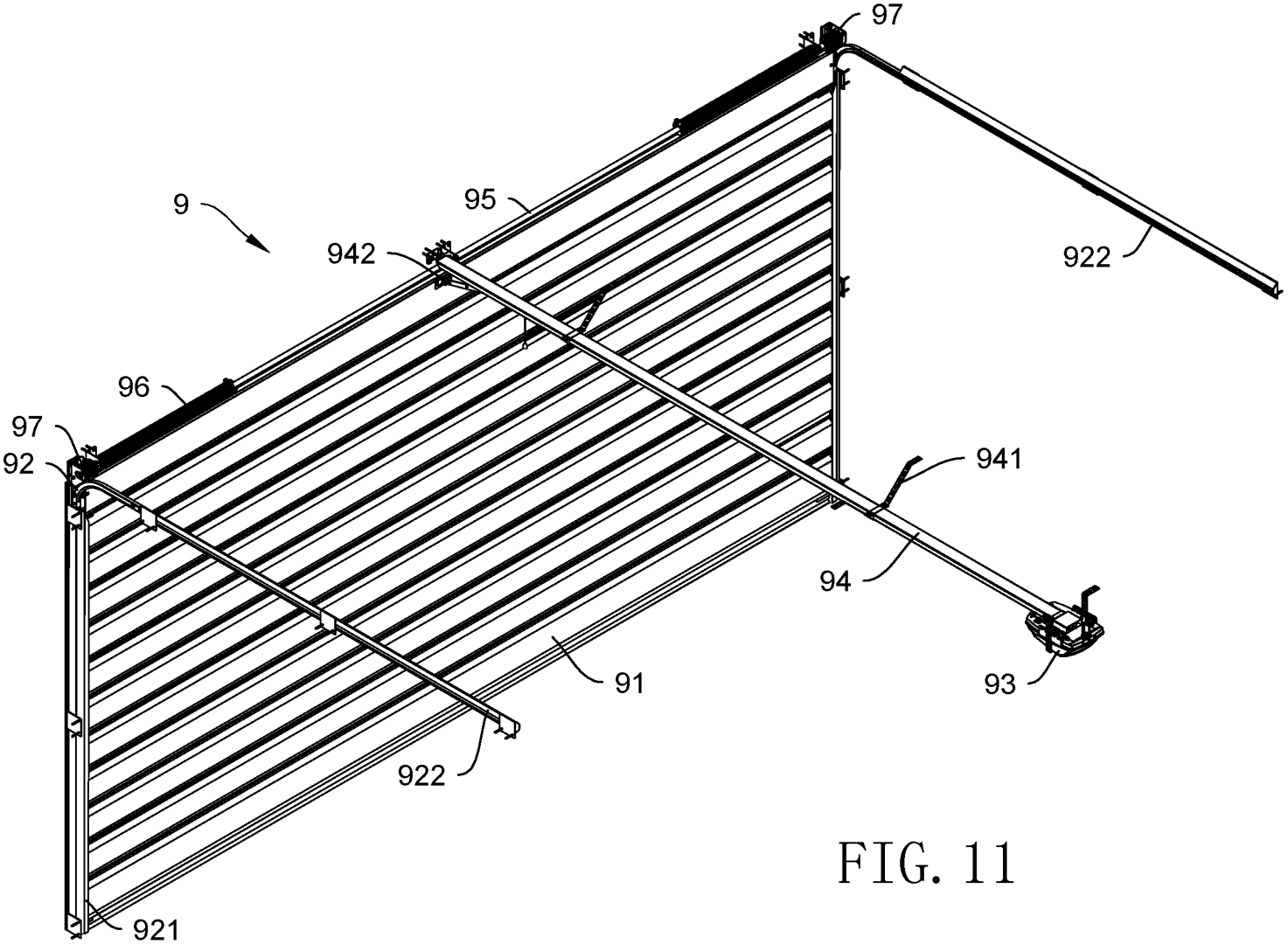
FIG. 11 is a perspective view of a conventional sectional door device.

Please refer to FIG. 10, which is a perspective view of disassembly and assembly of a part of a third embodiment of a sectional door driving device of the present disclosure. The difference between the third embodiment and the first embodiment is that the engagement assembly 311 of each of the two half-gears 31 of the third embodiment include a dovetail rib and a dovetail groove which can be mounted with each other tightly; the engagement assembly 321 of each of the half rope wheels 32 of the third embodiment can also include a dovetail rib and dovetail groove which can be mounted with each other tightly. In order to assemble the driving device, one of the half-gears 31 is placed on the surface of the shaft 4 first, and the dovetail rib and the dovetail groove of the engagement assembly 311 of the other of the half-gears 31 are placed correspondingly in position to the dovetail groove and the dovetail rib of the half-gear 31 placed on the surface of the shaft 4, and the other half-gear 31 is then slid to engage the half-gear 31 placed on the surface of the shaft 4. Similarly, in order to assemble the half rope wheels 32, the dovetail rib and the dovetail groove of the engagement assembly 321 of one of the two half rope wheels 32 are placed correspondingly in position to the dovetail groove and the dovetail rib of the engagement assembly 321 of the other of the two half rope wheels 32, and one of the half rope wheel 32 is slid to assemble with the other half rope wheel 32. The other parts of the third embodiment are equal to the aforementioned embodiments, so their descriptions are not repeated.

In the technical solution of the present disclosure, the gear and the rope wheel are disassembled into several half components which can be respectively assembled as complete components, and the half component is formed with the engagement assembly to improve the combination strength, so that it is not necessary to mount components from the end of the shaft, and the driving device of the present disclosure can be assembled or separated without detaching the shaft.

The present disclosure disclosed herein has been described by means of specific embodiments. However, numerous modifications, variations and enhancements can be made thereto by those skilled in the art without departing from the spirit and scope of the disclosure set forth in the claims.

What is claimed is:

1. A sectional door driving device, comprising a power assembly, a chassis assembly and a driving assembly, and the power assembly comprising a motor, a gear set and a control unit, and the power assembly fastened on a main chassis of the chassis assembly, wherein the driving assembly comprises two half-gears respectively in semicircular cylinder shape, and each of the two half-gears has a combination surface which is formed with an engagement assembly, and the two half-gears are engaged with each other by the engagement assemblies thereof to form a circular gear to cover a shaft of a sectional door mechanism, and the gear set comprises an output gear configured to drive the circular gear and the shaft to rotate.

2. The sectional door driving device according to claim 1, wherein the main chassis is formed with a gap to pass the shaft.

3. The sectional door driving device according to claim 2, further comprising two half-bearings configured to engage with each other to mount on the shaft.

4. The sectional door driving device according to claim 1, wherein each of the two half-gears is formed with at least one counterbore configured to lock with a screw.

5. The sectional door driving device according to claim 4, wherein the engagement assembly of each of the two half-gears comprises an engagement structure comprising a protruded part and a recessed part in cooperation with each other.

6. The sectional door driving device according to claim 4, wherein the circular gear is covered by two half rope wheels, and the two half rope wheels are assembled with each other as a rope wheel by engagement assemblies thereof, and the rope wheel is wound by a rope.

7. The sectional door driving device according to claim 6, wherein the engagement assembly of each of the two half-rope wheels comprises an engagement structure comprising a protruded part and a recessed part in cooperation with each other.

8. The sectional door driving device according to claim 7, wherein the chassis assembly comprises an auxiliary chassis which is formed with several holes and at least one combination board configured to combine with the main chassis by a fastener.

9. The sectional door driving device according to claim 8, wherein the rope comprises a first combination end configured to combine with a bottom part of a door leaf.

10. The sectional door driving device according to claim 9, wherein the rope comprises a second combination end configured to combine with a top part of the door leaf.

* * * * *